United States Patent [19]

Green

[11] 4,446,573

[45] May 8, 1984

[54] TROUSERS HAVING MODIFIED POCKET

[76] Inventor: William M. Green, P.O. Box 357, Acme, Mich. 49610

[21] Appl. No.: 443,858

[22] Filed: Nov. 22, 1982

[51] Int. Cl.[3] ..... A41D 27/20

[52] U.S. Cl. ..... 2/252; 2/247

[58] Field of Search ..... 2/252, 247, 248, 249, 2/250

[56] References Cited

U.S. PATENT DOCUMENTS 2,008,134 7/1935 Freedman ..... 2/247

2,265,101 12/1941 Crego ..... 2/247

4,006,494 2/1977 Knoppel ..... 2/247

*Primary Examiner*—Doris L. Troutman

*Attorney, Agent, or Firm*—Harness, Dickey & Pierce

[57] ABSTRACT

The jeans or trousers have a pocket or pockets sewn onto the hip portion to define an opening along the top of the pocket for gaining access to the interior of the pocket. The top of the pocket may be slanted for better access, and may include optional closure means or flap for closing the pocket. The interior of the pocket is provided with an opening through the hip portion of the trousers to permit access to the wearer's body.

15 Claims, 5 Drawing Figures

FIG. 1.
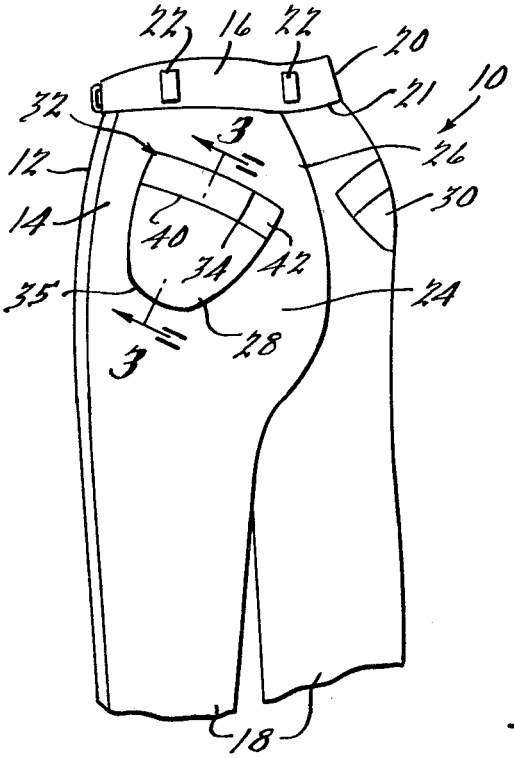
FIG. 2.
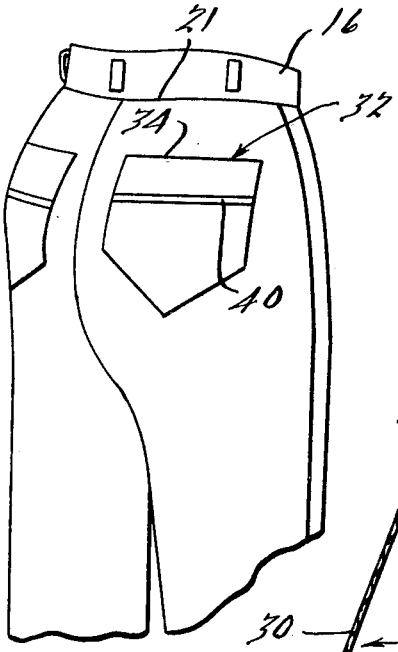
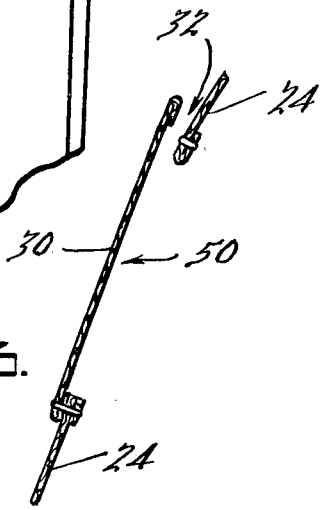
FIG. 3.
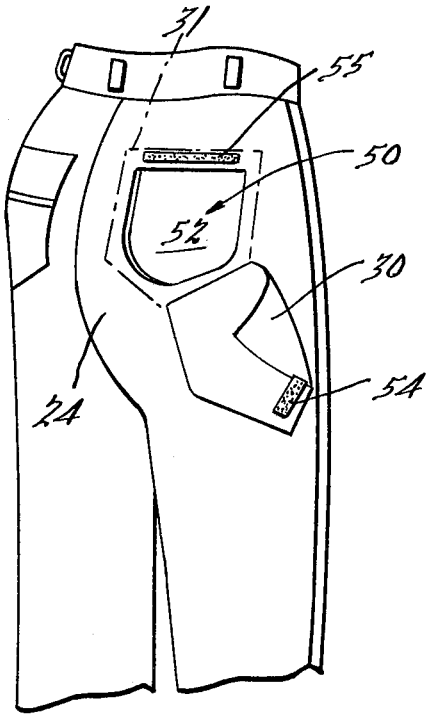
FIG. 4.
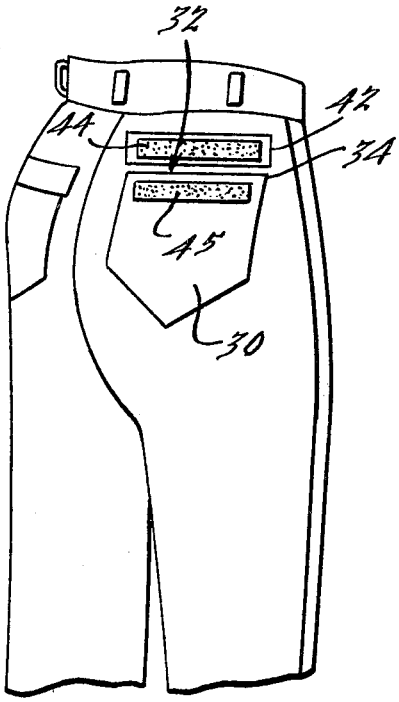
FIG. 5.

TROUSERS HAVING MODIFIED POCKET

BACKGROUND AND SUMMARY OF THE INVENTION

This invention pertains generally to wearing apparel and more particularly to a pair of pants or trousers provided with a cut out portion or opening in the seat or hip portion thereof, which opening is completely concealed from view by the outer fabric portion of the trouser's hip pocket.

Over the years there have been numerous developments in the construction of wearing apparel such as pants and trousers. For example, reference is made to U.S. Pat. No. 3,828,368 entitled "Wearing Apparel", issued to Lam on Aug. 13, 1974. This patent taught a conventional pair of pants or trousers in which the seat or rear portion is provided with apertures, openings or cut out portions therein, thereby exposing the wearer's skin or garment disposed beneath the trousers. In a modified form, a cover member is detachably connected to the seat of the trousers to cover the cut out portions.

Within the wearing apparel art there have also been developments in the construction of pockets for use on pants or trousers. Traditionally pockets have served primarily as a means of carrying articles of many and varied descriptions.

The present invention comprises wearing apparel in the form of a pair of trousers or pants having front and rear portions defining a waist portion and a pair of trouser leg members. The rear portion of the pants or trousers is provided with a hip portion disposed between the waist portion and the leg members. The hip portion includes a hip pocket comprised of a fabric portion disposed on the hip portion to define an opening along the top of the pocket for accessing the interior of the pocket. Within the interior of the pocket, and completely concealed from view by the fabric portion of the pocket, is a second opening through the hip portion of the trousers which communicates with the interior of the trousers between the front and rear portions. In one embodiment the pocket is sewn on a slant, in the sense that the top of the pocket is slanted towards the center seam of the rear portion and the bottom of the pocket is directed generally outwardly away from the center seam. To keep the pocket closed any number of closure means may be optionally provided. Such closure means would include a strip of velcro on the inside of the pocket fabric portion for engaging with a corresponding strip disposed on the hip portion of the trousers immediately beneath the pocket along the top edge thereof. Alternatively, buttons, snaps, or the like may be employed to hold the pocket closed. Furthermore, the pocket may be provided with an optional flap portion for covering the opening along the top portion of the pocket. The flap portion may or may not be provided with a closure means. In another embodiment the top of the pocket is substantially parallel to the waist portion and may or may not include optional closure means or optional pocket flaps.

Other objects, features, and advantages of the present invention will become apparent from the subsequent description and the appended claims, taken in conjunction with the accompanying drawings, in which:

BRIEF DESCRIPTION OF THE DRAWINGS

FIG. 1 is a perspective view illustrating the seat portion of a pair of trousers exemplary of one embodiment of the trouser construction of the present invention;

FIG. 2 is a similar perspective view exemplary of a second embodiment of the trouser construction of the invention;

FIG. 3 is a sectional view taken substantially along the long 3—3 of FIG. 1;

FIG. 4 is a perspective view of the trouser construction of the present invention illustrating the fabric outer portion of one of the pockets unstitched and folded back to reveal the cut out or opening in the hip portion of the trouser; and FIG. 5 illustrates one embodiment of trouser construction having a pocket flap along the top edge of the pocket.

DESCRIPTION OF THE PREFERRED EMBODIMENTS

With reference to the drawings a pair of pants or trousers 10 is provided with a front portion 12 and a rear portion 14, which define a waist portion 16 and a pair of trouser leg members 18. Waist portion 16 includes a conventional waist band 20 joined to the front and rear portions as along seam 21 and may include optional belt loops 22. The rear portion 14 is provided with a hip portion 24 disposed generally between the waist portion and the leg members, and having a rear trouser seam 26 which serves to divide the hip portion into left and right halves.

In accordance with the present invention, the hip portion 24 is provided with one or two hip pockets 28 and 30. Hip pockets 28 and 30 are secured, as by stitching, to the hip portion of the trousers and include an opening 32 along the top edge 34 of the pocket for accessing the interior of the pocket. Preferably, the pocket comprises a fabric portion or a patch, which may be cut from he same fabric as the trousers, although the pocket may be cut alternatively from a complementary fabric.

In appearance, the pocket portions 28 and 30 may be quite varied without departing from the spirit of the invention or the scope of the following claims. FIGS. 1, 2 and 5 illustrate three different trouser construction embodiments, each featuring a different pocket construction. The pocket illustrated in FIG. 1 may be characterised as a slanted style, in the sense that the top edge 34 is slanted or tilted inwardly and downwardly towards the trouser center seam 26, while the bottom portion 35 thereof is presented outwardly toward the outer hip seam 25. In other words, the top 34 lies on a line forming an acute angle with the waist portion 16 and waist band seam 21.

The embodiment of FIG. 2 illustrates a pocket construction which may be characterised as of a straight style, in the sense that the pocket top 34 lies along a line generally parallel to the waist portion 16 and waist band seam 21. Each pocket may further include optional stitching 40 for decorative and reinforcing purposes. A somewhat modified pocket construction is illustrated in FIG. 5, wherein a pocket flap 42 is secured, as by stitching, along the top 34 of the pocket 30. Pocket flap 42 thus serves to cover or close the opening 32, and may be provided with optional closure means such as velcro strips 44 and 45. While the pocket flap construction of FIG. 5 is illustrated in connection with a straight style pocket, it will be appreciated that a similar flap construction could be utilized in connection with the slant style pocket illustrated in FIG. 1, for example. It will be further recognized that those embodiments which employ velco strips as a closure means might alternatively employ other equivalent closure means such as zippers, snaps, buttons, and the like. It will be further recognized by those skilled in the art that while choosing among the many straight styled and slanted styled pocket constructions, is in part a matter of aesthetics, the slanted styled pocket may be preferred in that some find the slanted pocket easier to reach into.

With particular reference to FIGS. 3 and 4 the trouser construction of the present invention is illustrated in greater detail. It will be appreciated that while FIG. 3 has been chosen as a sectional view along the line 3—3 of FIG. 1 which illustrates a slanted style pocket, and while FIG. 4 illustrates a straight style pocket, the general construction of the trousers to be discussed is not in any way limited to the particular style of pocket employed. In accordance with the invention, hip portion 24 is provided with a cut out or opening 50 which communicates with the interior 52 of the trousers. Preferably the opening 50 defines an area less than the surface area of the outer pocket cover portion 30 and is so constructed and arranged to be completely concealed from view when pocket cover 30 is stitched in place as illustrated by the dashed lines 31 in FIG. 4. As illustrated in FIG. 3 the periphery of opening 50, as well as the periphery of pocket cover portion 30, are provided with hemmed edges to prevent the fabric from unravelling or fraying. If desired, an optional closure means can be provided on the interior of the pocket along the top edge 34 thereof to keep the pocket closed. Although other equivalent closure means might be employed, FIG. 4 illustrates a velcro strip 54 disposed along the inside of the pocket along the top edge 34 thereof, and a complementary velcro strip 55 disposed along the hip portion of the trousers generally above opening 50 and in registry with velcro strip 54.

In use, the trousers may be worn by members of either sex. The pocket, so equipped with opening 50, may be used to carry certain articles, such as a handkerchief, for instance, and also permits access to the wearer's body by reaching through openings 32 and 50 respectively.

Those skilled in the art will appreciate that, while the pocket of the present invention has been illustrated as a patch pocket, the pocket construction of the invention may be equally applied to other pocket styles, such as the welt pocket, for example.

While it will be apparent that the preferred embodiments of the invention disclosed are well calculated to fulfill the objects above stated, it will be appreciated that the invention is susceptible to modification, variation and change without departing from the proper scope or fair meaning of the invention.

What is claimed is:

1. In a pair of trousers having front and rear portions defining a waist portion and a pair of trouser leg members, said rear portions being provided with a hip portion disposed between said waist portion and said leg members, wherein the improvement comprises:

pocket means having cover portion disposed on said hip portion to define a first opening along the top of said pocket for accessing the interior of said pocket;

said hip portion defining a second opening communicating with the interior of said trousers between said front and rear portions, said second opening being completely covered by said cover portion of said pocket means and communicating directly with the interior of said pocket.

2. The improvement as set forth in claim 1 further comprising closure means disposed on said pocket means for releasably closing said first opening.

3. The improvement as set forth in claim 1 wherein said pocket means includes a flap for covering said first opening.

4. The improvement as set forth in claim 1 wherein the top of said pocket means lies on a line forming an acute angle with said waist portion.

5. The improvement as set forth in claim 1 wherein the top of said pocket means lies on a line generally parallel to said waist portion.

6. The improvement as set forth in claim 1 wherein said front and rear portions from an outer hip seam and the bottom portion of said pocket means is presented outwardly toward said outer hip seam.

7. The improvement as set forth in claim 3 wherein said flap includes closure means for holding said flap against said pocket means.

8. The improvement as set forth in claim 1 wherein said pocket means is sewn onto the hip portion of said trousers.

9. A trouser hip pocket construction for use on a pair of trousers having a seat portion comprising:

fabric means disposed on said seat portion defining a pocket having an interior region and a first opening for accessing said interior region, said pocket defining a second opening through said seat portion and in direct communication with said interior region thereby permitting access to the wearer's body from within said pocket.

10. The hip pocket construction of claim 9 wherein said fabric means includes cover means sewn to the seat portion of said trousers.

11. The hip pocket construction of claim 9 wherein said trousers include a waistband portion and said first opening lies on a line forming an acute angle with said waistband portion.

12. The hip portion construction of claim 9 wherein said trousers include a waistband portion and said first opening lies on a line generally parallel to said waistband portion.

13. The hip pocket construction of claim 9 further comprising closure means disposed on said fabric means for releasably closing said first opening.

14. The hip pocket construction of claim 9 further comprising flap for covering said first opening.

15. A trouser hip pocket construction for use on a pair of trousers having an exterior seat portion comprising:

fabric pocket cover portion having hemmed top, side and bottom edges to prevent fraying, said cover portion being stitched to said exterior seat portion about said side and bottom edges to define a pocket interior;

a first opening through said seat portion directly beneath and entirely covered by said cover portion for accessing a wearer's body, said first opening being hemmed about the outer periphery to prevent fraying; and wherein said cover portion and said exterior seat portion define a second opening along said top edge for direct access to said pocket interior and said first opening.

* * * * *